US007213602B2

(12) United States Patent
Silva

(10) Patent No.: US 7,213,602 B2
(45) Date of Patent: May 8, 2007

(54) MULTIPLE BAND HAIR FASTENER

(76) Inventor: David Alan Silva, 2314 Lafayette St., Santa Clara, CA (US) 95050

( * ) Notice: Subject to any disclaimer, the term of this patent is extended or adjusted under 35 U.S.C. 154(b) by 63 days.

(21) Appl. No.: 10/131,925

(22) Filed: Apr. 24, 2002

(65) Prior Publication Data

US 2003/0200981 A1 Oct. 30, 2003

(51) Int. Cl.
*A45D 8/00* (2006.01)

(52) U.S. Cl. ..... 132/273

(58) Field of Classification Search ..... 132/273, 132/200, 275, 276, 277; D28/32, 33
See application file for complete search history.

(56) References Cited

U.S. PATENT DOCUMENTS 6,289,903 B1 * 9/2001 Haufler ..... 132/275
6,601,590 B2 * 8/2003 Neary ..... 132/275
6,612,312 B2 * 9/2003 Silva ..... 132/200
6,647,991 B2 * 11/2003 Silva ..... 132/273

* cited by examiner

*Primary Examiner*—Todd E. Manahan
*Assistant Examiner*—Rachel A. Running

(57) ABSTRACT

A multiple band fastener and method for securing sections of hair of a human being in sections and for aligning hair bands. The apparatus is a semicircle headband that has a plurality of hair bands integrally attached and aligned longitudinally along its top. In use, the headband is attached to the hair and hair sections are neatly aligned and secured to the multiple band fastener by placing each corresponding hair section into the corresponding hair band. Each band always remains aligned with each other and the multiple band hair fastener is easily removable and reusable.

2 Claims, 3 Drawing Sheets

MULTIPLE BAND HAIR FASTENER

BACKGROUND OF THE INVENTION

1. Field of the Invention

The present invention and method relates to a multiple band hair fastener. More particularly a semicircle headband with a plurality of hair bands integrally attached to its top for keeping hair sections in rows and hair bands aligned.

2. Description of Prior Art

Many people like to put their hair up in various styles. One way to put the hair up is to twist a plurality of sections of hair around the face and secure them with hair bands. This process is effective and stylish but it is difficult for a non-hairstylist to achieve, especially when trying to align each hair section with the previous and trying to keep the bands in alignment. It is also a time consuming process.

SUMMARY OF THE PRESENT INVENTION

An object of the present invention is to provide an instrument which is convenient, practical, and inexpensive for use in hair styling.

A further object is to provide an instrument that will keep a plurality of hair bands neatly aligned.

A further object is to provide a single instrument that will keep a plurality of hair sections in neatly aligned rows.

A further object is to provide such an instrument that can be used unassisted by the individual styling their hair, eliminating the expense of a professional stylist.

A further object is to provide an instrument that can be reused over and over again.

A further object is to provide an instrument that will quickly hold the user's hair up in a neatly secured style.

According to one aspect of the present invention, there is provided a multiple band hair fastener comprising a flexible semicircle headband with a plurality of hair bands integrally attached to its top.

According to the arrangement described above the headband is placed on the user's head. The user then twists tiny sections of hair, directly in front or behind each band, and secures the section with the corresponding bands. Because all the bands are integrally attached, equally spaced apart, and aligned with the headband, the twisted hair sections remain conveniently spaced apart and the bands don't move out of alignment.

Accordingly a preferred embodiment of the headband is a semicircle shape made of plastic with a plurality of elastic bands integrally attached and aligned longitudinally along the semicircle headband top. Each band is spaced apart substantially at an equal distance from the next. There could be an elastic band attached to each end of the plastic semicircle headband to help hold it close to the head. There could be hooks between each band for securing the hair between the band and hook by securing the band to the hook with the hair intermediate the band and the top of the headband.

The above embodiments can have an additional covering of fabric or hair over the bands like the traditional scrunchy or hair-band.

Other objects, features and advantages of the present invention will become apparent from the following description of the preferred embodiments given with reference to the accompanying drawings.

BRIEF DESCRIPTION OF THE DRAWINGS

In the accompanying drawings

PREFERRED EMBODIMENTS

Figure 1:
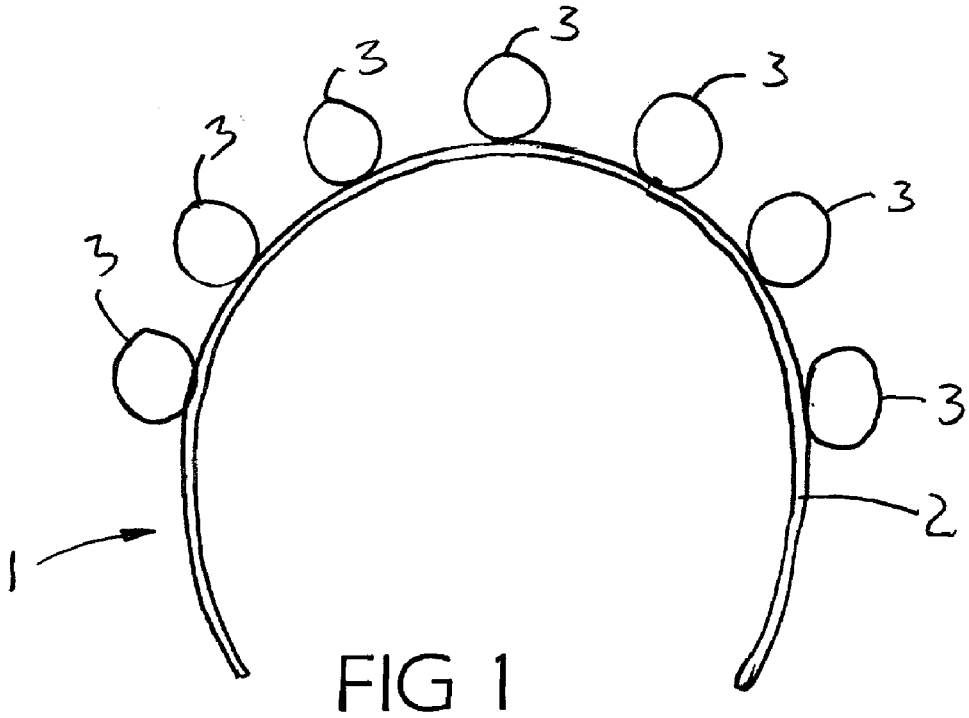
FIG. 1 is a front view showing a multiple band headband fastener according to the present invention.
Figure 2:
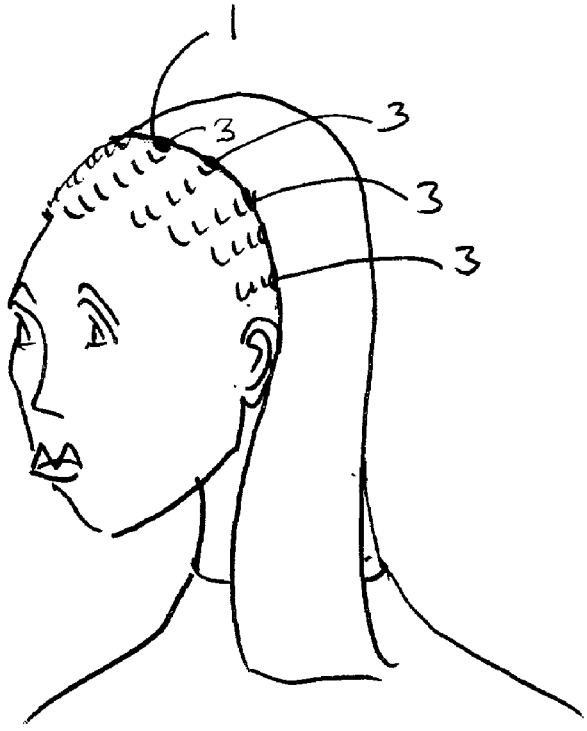
FIG. 2 is a schematic view showing the multiple band headband fastener secured to the user's hair.

Referring to FIGS. 1 and 2 of the accompanying drawings, there is illustrated a multiple band headband fastener, generally designated by reference numeral 1, embodying the present invention. The semicircle headband fastener 1 comprises a semicircular headband 2 and a plurality of looped band portions 3.

In use of the multiple band headband fastener FIG. 2 the user places the present invention 1 onto their hair. The user then takes sections of hair in front or behind each headband 2, twists them and places the corresponding section between the corresponding looped band 3 and corresponding hook 5 to secure.

Figure 3:
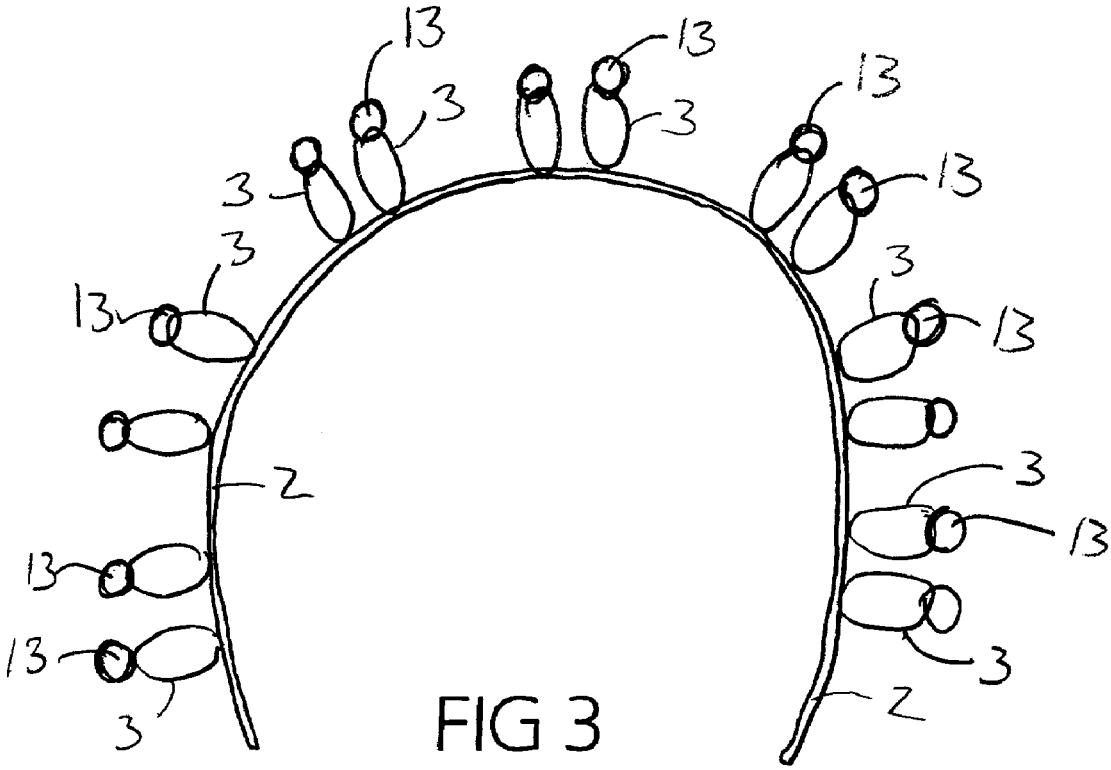
FIG. 3 is a front view of another version of the multiple band headband fastener.
Figure 4:
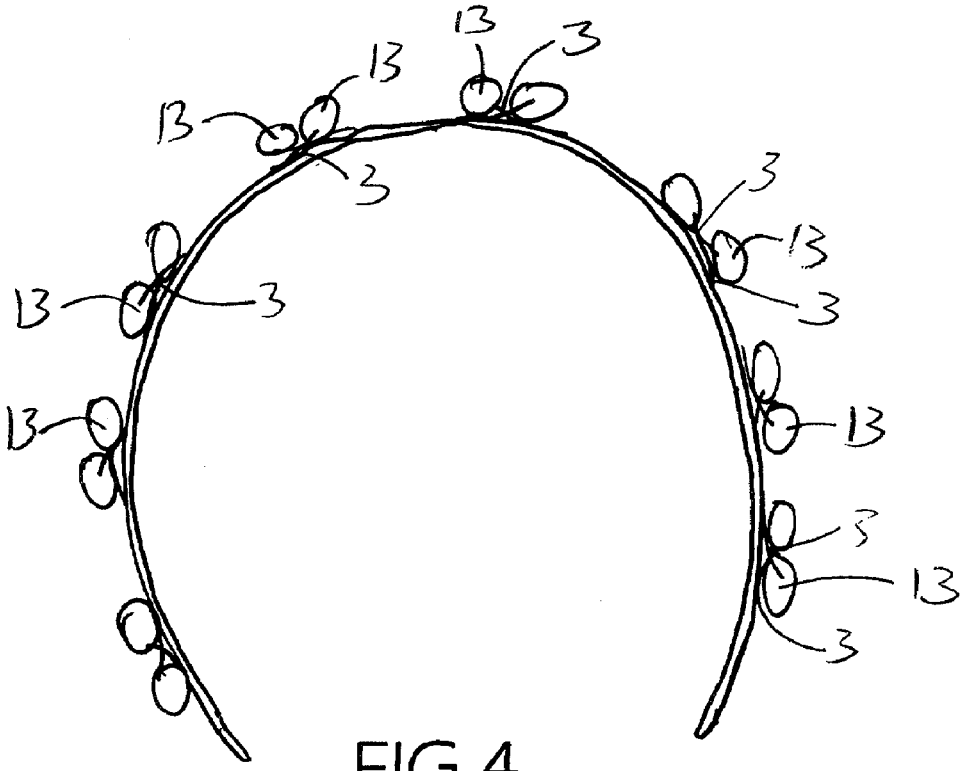
FIG. 4 is a front view of FIG. 3 with the beads overlapped according to the present invention.

In another embodiment shown in FIG. 3 and 4 the semicircle headband 2 has a plurality of looped bands 3 with a bead 13 attached to each. In use the hair section is placed between two looped bands 3 and the bead 13 are overlapped to secure.

Figure 5:
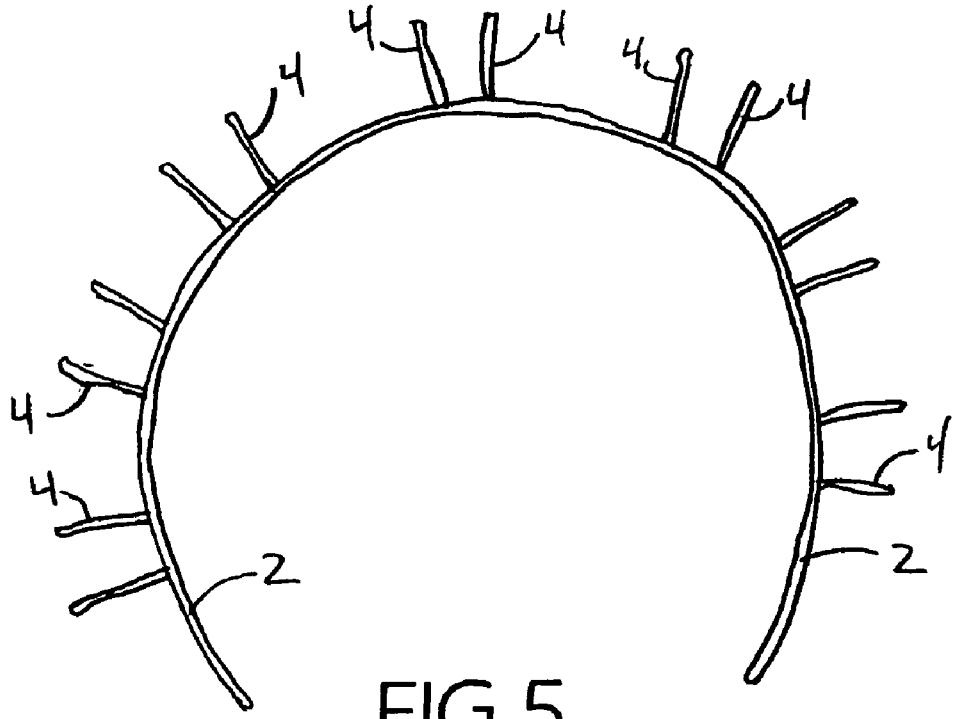
FIG. 5 is a front view of another version of the multiple band headband fastener.

In another embodiment shown in FIG. 5 the semicircle headband 2 has a plurality of straight fabric ties 4 attached to the headband 2. In use the hair is either placed between two ties 4 and the ties 4 are tied or wrapped together to secure or the section can be wrapped or tied with a single tie to secure. The tie could be any material such as wire, ribbon, hair, or elastic.

Figure 6:
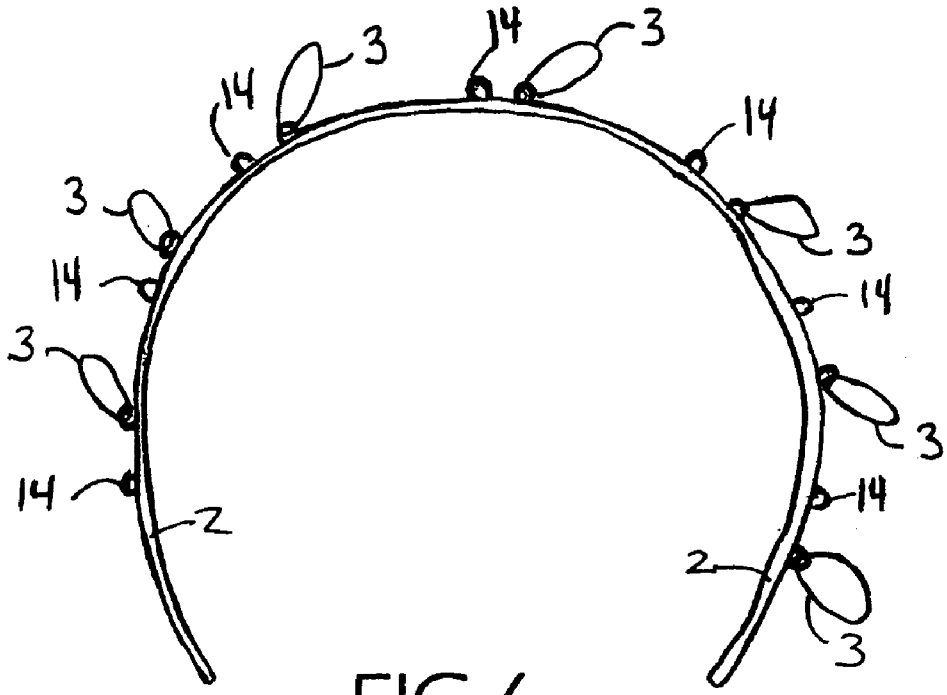
FIG. 6 is a front view of another version of the present invention.

In another embodiment shown in FIG. 6 the semicircle headband 2 has a plurality of hooks 14 along its top for removably connecting a plurality of bands 3 to the headband.

The present invention being thus described, it is obvious that the same may be varied in many ways. For instance, the hair bands could be any type of hair band known in the art, as long as they are integral to the headband; and anyway to integrally attach the bands to the top of them will work. The semicircle headband can be a full circle with the bands attached to half of the circle shape. Also, any way to use the present invention obvious in the art should apply. Such variations are not to be regarded as a departure from the spirit and scope of the invention, and all such variations as would be obvious to those skilled in the art are intended to be included within the scope of the following claims,

I claim:

1. A multiple band fastener for securing a hair section of a human being and for aligning a plurality of hair bands comprising:

a) a plastic semicircular headband having a top portion and bottom portion;

b) a plurality of elastic looped hair bands integrally attached along the top portion of said semicircular headband for securing sections of hair to the top of the semicircular headband;

c) said looped hair bands being aligned at a distance from each other longitudinally along said semicircular headband;

d) a bead attached to each looped elastic hair band;

e) wherein in use the semicircular headband is placed on the head of said human being; each hair section of said human being are secured in place by placing one said bead through the corresponding said looped hair band with the hair section therebetween, thereby securing the hair section to the semicircular headband.

2. A multiple band fastener for securing a hair section of a human being and for aligning a plurality of hair bands comprising:

a) a plastic semicircular headband with a top portion and a bottom portion;

b) a plurality of elastic looped hair bands integrally attached along the top of said semicircular headband for securing sections of hair to the top of the semicircular headband; and c) a plurality of hook elements associated with each hair band;

d) said looped hair bands and said hook elements being aligned longitudinally along said semicircular headband, said hook elements and said hair bands alternate longitudinally along the headband from one end to the other end;

e) wherein in use the semicircular headband is placed on the head of said human being; each hair section of said human being are secured in place by placing the said looped hair band over the corresponding hook with the hair section therebetween, thereby securing the hair section to the semicircular headband.

* * * * *